United States Patent [19]

White

[11] 4,304,249

[45] Dec. 8, 1981

[54] CONTROL UNITS

[75] Inventor: Joseph W. White, London, England

[73] Assignee: T.I. Domestic Appliances Limited, London, England

[21] Appl. No.: 39,749

[22] Filed: May 16, 1979

[30] Foreign Application Priority Data

May 31, 1978 [GB] United Kingdom ..... 24970/78

[51] Int. Cl.[3] ..... F22B 35/00

[52] U.S. Cl. ..... 137/94; 122/448 R; 236/23

[58] Field of Search ..... 137/94, 65; 122/446, 122/448; 236/237, 23

[56] References Cited

U.S. PATENT DOCUMENTS 2,774,565 12/1956 Klemp ..... 137/94 X
2,917,162 11/1975 Trotter ..... 236/23
4,184,457 1/1980 Trotter ..... 236/23

FOREIGN PATENT DOCUMENTS 363777 9/1962 Switzerland ..... 137/94

*Primary Examiner*—Alan Cohan
*Attorney, Agent, or Firm*—Mason, Fenwick & Lawrence

[57] ABSTRACT

A control unit for a gas-fired water heater comprises a resiliently-loaded main valve for controlling gas flow to a gas burner of the heater, the main gas valve being opened and closed by a flexible diaphragm exposed to pressure of water flowing through the water heater. A subsidiary gas valve located upstream in the gas supply of the main gas valve has a permanently open by-pass and is actuable by a user operated control which also adjusts the resilient loading of the main gas valve in such manner as to adjust the rate of water flow and the rate of gas flow to provide hot water of a required temperature and at a required rate of flow.

7 Claims, 4 Drawing Figures

CONTROL UNITS

This invention relates to control units and has particular reference to control units for gas-fired water heaters of the so-called instantaneous kind.

Conventionally, such water heaters have a control unit which allows gas to flow, at full rate, to the main burner of the heater once the water flow through the heater has reached a predetermined minimum flow. The minimum flow rate is of a value such that a predetermined rise in temperature of water passing through the heater is achieved conventionally a temperature rise of about 80° F. is realised. Included in the water flow path through the heater is a water flow governor or throttle that is preset to ensure the maintenance of the minimum flow over a known range of variation in water inlet pressure. The water flow governor is arranged to restrict water flow as soon as an increase in inlet water pressure would otherwise result in an increase in water flow.

The user is not able to vary the setting of the water governor but, in some water heaters, is provided with a control by which small variation in water flow can be made thus giving some control over temperature rise. However, in conventional water heaters, the range of usercontrolled variation has been very small. It is not, in general, possible to operate a conventional gas-fired water heater at very low water flow rates. Either such rates are below the predetermined water rate necessary to permit gas flow to the main burner or else the rise in temperature of water flowing through the heater at the low flow rate is excessive and may give rise to boiling of the water within the heater.

The restriction on the operation of the conventional gas-fired water heater means that the latter cannot be used, for example to heat water for a domestic shower.

Accordingly, it is an object of the present invention to provide a control unit for a gas-fired water heater that will enable a user to exercise a greater degree of control over the operating conditions of the heater than hitherto.

Figure 1:
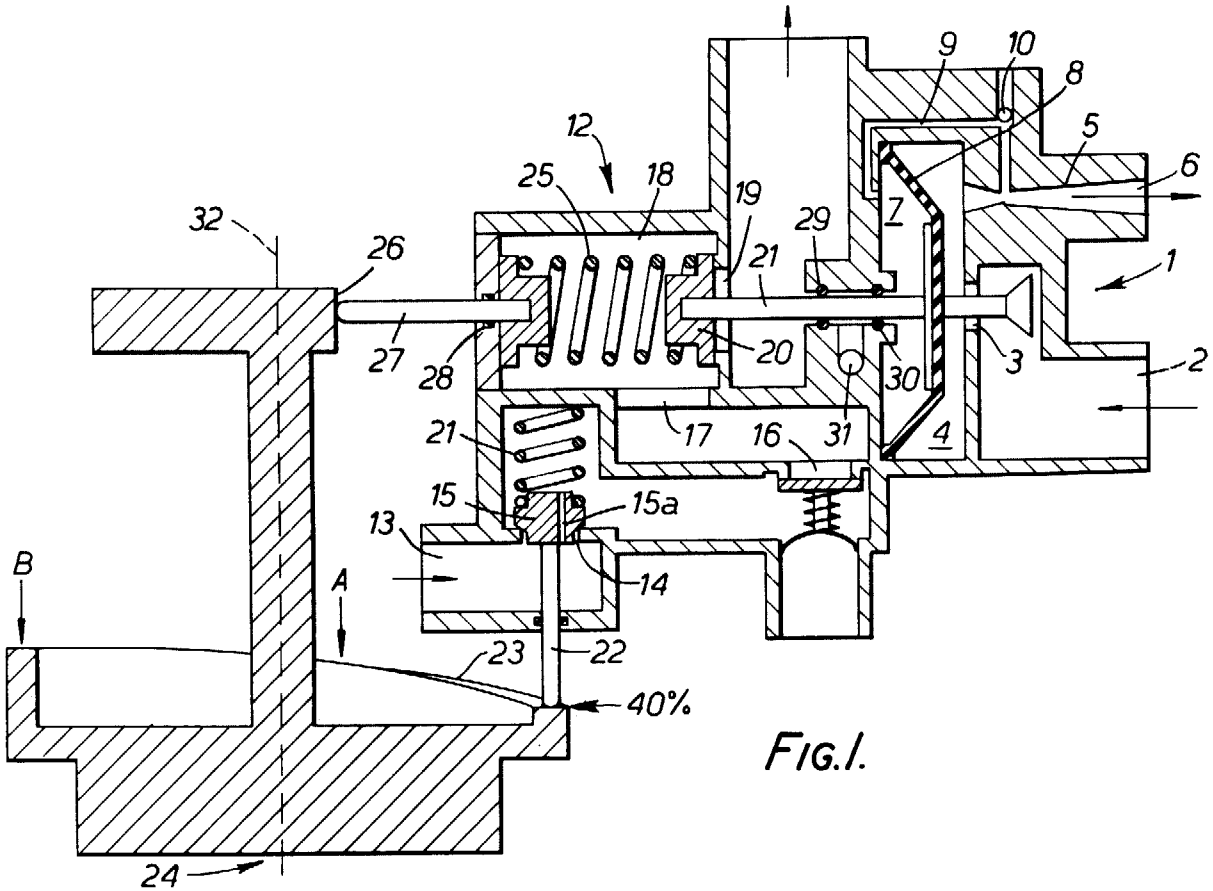
Figure 2:
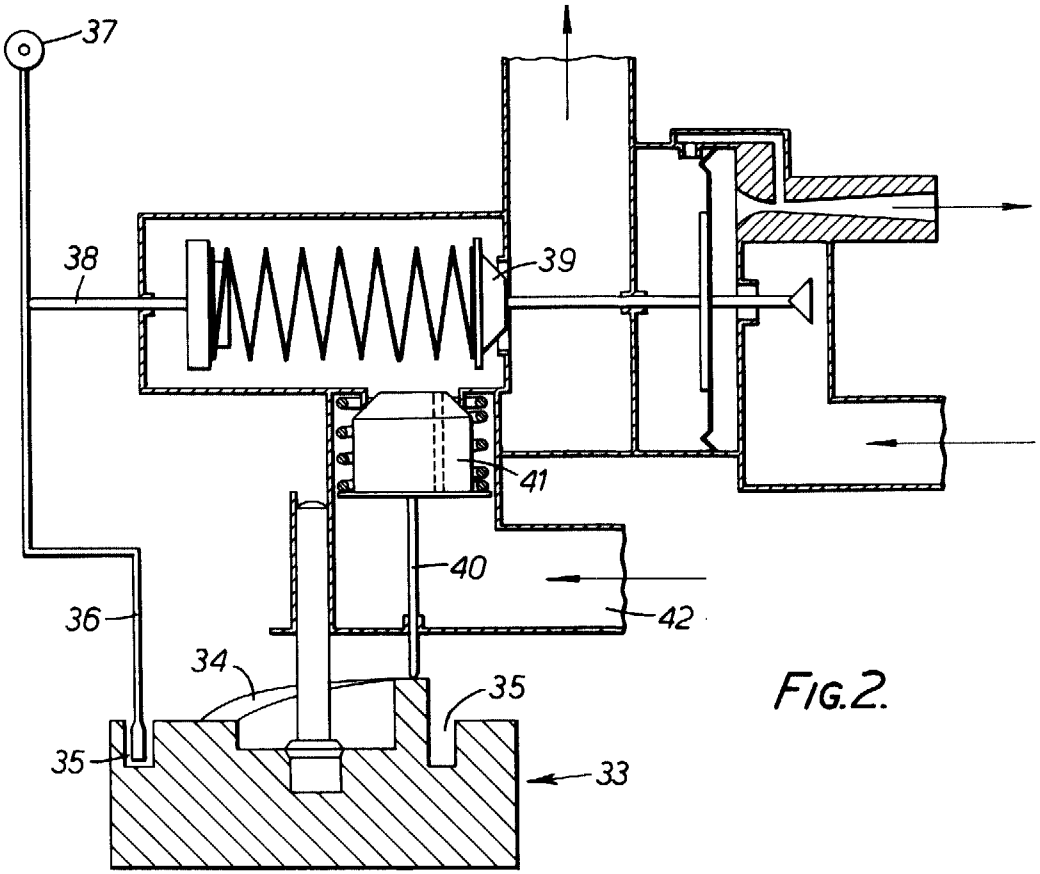
Figure 3:
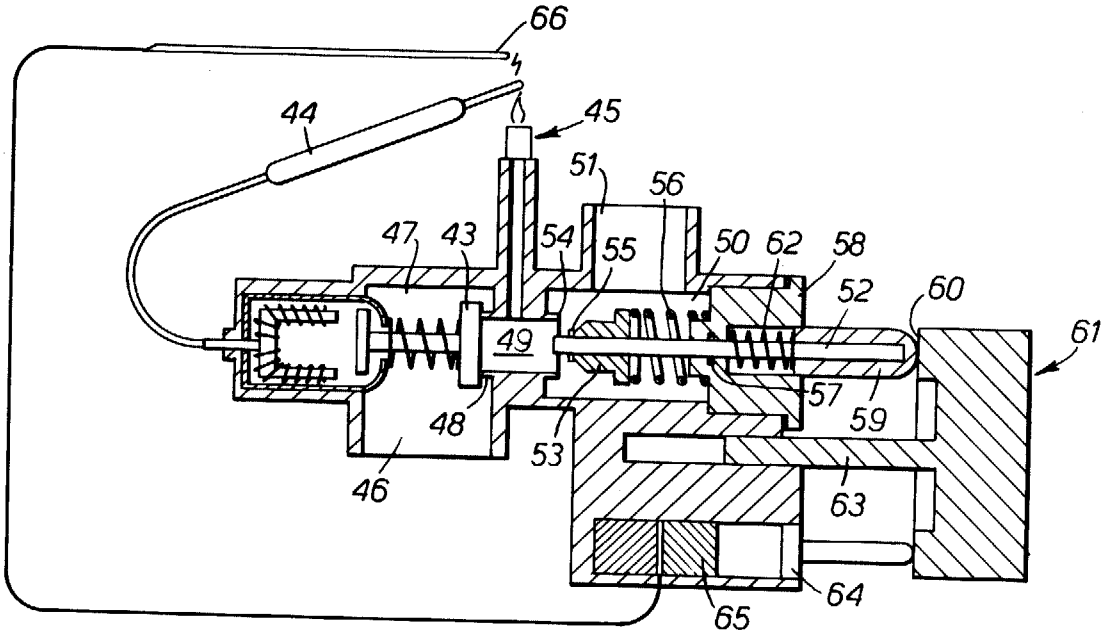
Figure 4:
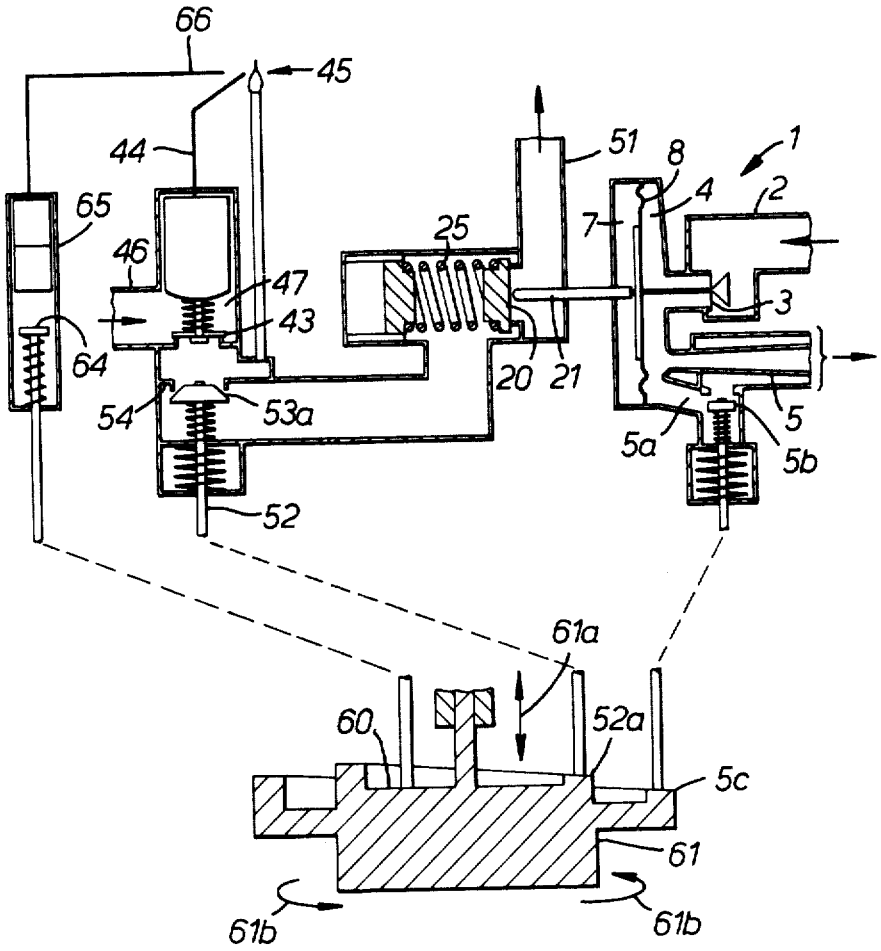

By way of example only, embodiments of the invention will now be described in greater detail with reference to the accompanying drawings of which FIGS. 1 and 2 show, in diagrammatic form only, first and second embodiments respectively, FIG. 3 shows, in diagrammatic form only, associated control equipment and, FIG. 4 shows a further embodiment in schematic form only.

The embodiment shown in FIG. 1 includes a water flow section 1 with a water inlet 2 leading via a controlled aperture 3 to a chamber 4 and thence via a venturi 5 to a water outlet 6.

The chamber 4 is separated from another chamber 7 by a water-impermeable diaphragm 8. As can be seen from the drawing, chamber 4 is exposed to the water pressure at the mouth of the venturi 5 whilst chamber 7 is exposed via passageway 9 to the water pressure at the throat of the venturi 5. Included in the passageway 9 is the conventional valve 10 which ensures slow opening of the main gas valve to be described below. Examples of such slow opening or ignition retarding valves are found in U.S. Pat. Nos. 3,917,162 and 4,184,457.

Coupled to the diaphragm 8 is a water governor or throttle 11 which controls water flow through the aperture 3.

The embodiment also includes a gas section 12 with a gas inlet 13 connected via an opening 14 controlled by a gas valve 15, a further gas valve controlled opening 16 which is a schematic showing of other components described in more detail below, aperture 17 to chamber 18 the outlet 19 from which is controlled by a main gas valve 20 mounted upon an operating stem 21 which interconnects valve 20, diaphragm 8 and water governor 11.

Gas valve 15 is resiliently urged into its closed position by spring 21 but is openable against the spring 21 by an operating rod 22 movable by a cam surface 23 on a control knob 24 to be described in more detail later.

In its closed position shown in FIG. 1, valve 15 does not completely prevent gas flow from the inlet 13 to the valve controlled opening 16. Valve 15 has a permanently-open by-pass **15*a*** which may be formed in the valve itself, as shown, or in a suitable dividing wall.

Main gas valve 20 is resiliently urged on to its seating by a spring 25, the pressure exerted on the valve being adjustable by a second cam surface 26 on the control knob 24. The surface 26 acts via an operating rod 27 which passes through a wall of the chamber 18, leakage of gas being prevented by seals 28.

Leakage along the operating stem 21 is prevented by spaced seals 29, 30, a connection 31 to the space between the seals being provided for test purposes.

The control knob 24 is mounted for rotation about an axis indicated by the dotted line 32, rotation producing synchronised movement of the two cam surfaces 23 and 26.

The cam surfaces are so contoured that, in the position shown gas valve 15 is closed but the by-pass **15*a* permits a gas flow of 40% of that permitted when the valve 15** is fully opened.

Simultaneously, cam surface 26 has allowed maximum movement to the left (as viewed in FIG. 1) of the operating rod 27 and in this position, the closing force exerted on valve 20 is at a minimum. The inlet water pressure required to move main gas valve 20 to its fully opened position is very low and the water flow through the heater is very low. This low water flow rate combined with the restriction on the rate of flow of gas exercised by valve 15 enables the heater to provide hot water at a very low flow rate suitable, for example, for a domestic shower.

Rotation of the control knob 24 through about 70° brings point A on cam surface 23 directly beneath operating rod 22 and this movement of the cam surface lifts valve 15 off its seating by an amount sufficient to permit a gas flow rate of 60% of that permitted when valve 15 is fully opened. The rotation of the control knob 24 increases, through cam 26 and operating rod 27 the loading on spring 25 and thus increases the inlet water flow necessary to move main gas valve 20 to its fully opened-position. Thus, in this position of the control knob a higher rate of gas flow and a higher rate of water flow are permitted. Under such conditions, the water heater may be used to supply hot water for domestic purposes such as washing-up, where hot water at a reasonably high flow rate is required.

Further rotation of the knob 24 in the same direction as before, lifts valve 15 towards and into its fully-opened position when point B on cam surface 23 is beneath operating rod 22. Gas can now flow at its maximum permitted rate. At the same time, cam surface 26 acting through operating rod 27 increases further the resilient loading of main gas valve 20 and the inlet water flow required to lift this valve off its seating. In this condition, both gas flow rate and water flow rate are at a maximum and the heater is able to provide hot water at the maximum flow rate. This high flow rate may be used for filling a bath, for example.

FIG. 2 shows an alternative form of the invention in which a control knob 33 has a cam surface 34 similar to cam surface 23 of the embodiment shown in FIG. 1 and a cam track 35 in which moves one end of a lever 36 pivotally mounted at 37 and which bears on an operating rod 38 through which pivotal movement of the lever is transmitted to vary the resilient loading of main gas valve 39 which corresponds with gas valve 20 of the embodiment shown in FIG. 1.

Cam surface 34 is operatively linked via an operating rod 40 to a gas valve 41 that controls gas flow from a gas inlet 42 to the main gas valve 39 as shown, there being no intermediate valve corresponding with valve 16 of the embodiment shown in FIG. 1.

The water section of the embodiment of FIG. 2 is similar in construction and operation with that of the embodiment of FIG. 1 and will not be described further.

The contours of cam surface 34 and of cam track 35 are selected to provide the required interrelation of gas flow with water flow.

In both the control units described above, the main gas flow control valve is of a design such that once the resilient loading of the valve has been overcome by pressure of water on the diaphragm, the control valve moves to its fully open position and remains in that position until water flow through the venturi ceases. The main gas valve is simply an "on-off" control only.

The control units described above with reference to FIGS. 1 and 2 are part only of the total control apparatus of the water heater and will be associated with other control equipment providing the normal pilot safety devices and/or flame failure devices and light-up facilities.

One form of such other control equipment is shown in diagrammatic form in FIG. 3. The equipment includes the further gas controlled opening 16 of FIG. 1 and which, in FIG. 3, is an electromagnetically operated valve 43 powered by a thermocouple indicated diagrammatically at 44 and exposed to the heat of a pilot burner indicated at 45.

The equipment shown in FIG. 3 has a gas inlet 46 leading to a chamber 47 in which is located the electromagnetic operating valve 43 and the valve itself which cooperates with a seating 48 formed at one end of an internal passageway 49 leading to a second chamber 50 with an outlet 51.

The pilot burner 45 is joined to the passageway 49 between the seatings 48 and 54.

Extending into chamber 50 is an operating rod 52 on whose inner end is slidably mounted a gas valve 53 which cooperates with a seating 54 formed on the other end of the internal passageway 49 to control gas flow from the passageway 49 into the chamber 50.

Valve 53 is located on the rod 52 by a stop 55 against which the valve is urged by a spring 56.

Seals 57 prevent leakage of gas along the rod 52 where it passes through a mounting plug 58 and, externally, the rod is fitted with a bearing guide 59 whose end is in contact with a cam surface 60 on a control knob 61. The end of the guide 59 is urged into contact with the cam surface by means of a spring 62.

Control unit 61 has a spindle 63 by means of which it is mounted in a suitable socket in the control equipment housing. The cam surface 60 also controls movement of a hammer 64 of a piezo-electric crystal unit 65 also contained, as shown in the housing first mentioned. The output of the piezo-electric unit 65 is connected to a spark electrode 66 positioned adjacent the pilot burner 45.

The equipment shown in FIG. 3 operates in the following manner. Pushing a control knob 61 will cause valve 53 to seat on seating 54 so cutting off gas flow to outlet 51. Further movement will cause the end of the operating rod 52 to lift the valve 43 from its seating 48 and allow gas flow to the pilot burner 45. At the same time, hammer 64 strikes the crystal unit 65 and a spark is generated at electrode 66 and ignites gas issuing from the pilot burner. The knob 61 must be held in until the thermocouple is fully operational and generating sufficient current to cause the electromagnet of the valve 43 to hold the latter open. The knob is then released permitting gas flow to the outlet 51.

When the control unit of FIG. 1 is used with the equipment shown in FIG. 3, inlet 46 of the equipment of FIG. 3 is fed with gas from valve 15 and the valve controlled opening 16 shown in FIG. 1 is constituted by the electromagnetically operated valve 43. Outlet 51 of the equipment shown in FIG. 3 is then in direct communication with opening 17 of the unit shown in FIG. 1.

The sequence of operation of the equipment shown in FIG. 3 and described above is not changed by the incorporation of the equipment into the control unit of FIG. 1 as a supply of gas is always available to inlet 46 because of the by-pass 15*a*.

The control units described above may be incorporated in multi-point water heaters for example, the water outlets of the units being connected to the water path of the heaters, and hot water draw-off points being positioned in the usual domestic locations.

It will be appreciated that, in the case of the embodiment shown in FIG. 1, movement of the valve 15 and the loading of the spring 25 may be achieved by mechanisms other than those shown in FIG. 1. Linkages involving pivoted levers can be used instead.

In a further embodiment of the invention, a control unit of the form shown in FIG. 3 is used but with gas valve 53 profiled to give a required range of gas flows to outlet 51 dependent upon its position relative to its seating 54, in conjunction with a modified form of control knob able to position the valve 53 in those positions, and in conjunction with means for controlling the rate of flow of water through the heater. Such means may comprise a by-pass across the venturi, the rate of flow through the by-pass being adjustable by means of a control valve operated by a suitable control surface on the control knob 61.

The further embodiment is shown in FIG. 4 in diagrammatic form only. Those components of the FIG. 4 embodiment that are identical with components shown in FIG. 1 and FIG. 3 have been given the same reference numbers.

The profiled gas valve is indicated at 53*a* the position of which relative to its seating 54 is determined by cam surface 52*a* on control knob 61.

Venturi 5 has a by-pass 5*a* the rate of flow through which is adjustable by means of a control valve 5*b* operated by a cam surface 5*c* on control knob 61.

In this case, the control knob 61 is capable of axial movement as indicated by arrows 61*c* to carry out the start-up operation described above and rotational movement about its axis as indicated by arrows 61*b* to position the valve 53*a* by means of an appropriately-shaped cam surface 52*a* on the knob and to adjust the water flow control valve 5*b* in the venturi by-pass by means of a further appropriately-shaped cam surface 5*c* on the knob 61. After the start-up or ignition procedure has been completed, the user releases the knob 61 and then allows gas valve 53*a* to assume its fully open condition at which time the by-pass valve 5*b* is fully opened so that both gas flow and water flow are at a maximum. Thereafter, the user rotates the knob 61 into a position appropriate to the output he requires from the heater, the gas valve 53*a* moving towards its seating by the required amount and the by-pass flow being subjected to a corresponding reduction.

In the further embodiment, control of gas flow by the profiled valve 53*a* replaces the control by valve 15 of the embodiment of FIG. 1, whilst the adjustable by-pass control valve 5*b* replaces the variable loading of the gas valve 20 to control water flow.

A single control knob can then be used to control the heater both for lighting-up purposes and for control of water flow and heating rate.

The further embodiment just described is, of course, used in conjunction with a conventional main gas flow control valve linked to a diaphragm flexed by the flow through a venturi. In FIG. 4, main gas flow control valve 20 is shown linked by connecting rod 21 to flexible diaphragm 8. The main gas valve 20 is resiliently loaded by spring 25 to ensure that it opens fully once the flow through the venturi has exceeded a predetermined rate. Again, the main gas valve 20 is either fully open or fully shut, variation of gas flow to the main burner being provided by the valve 53*a*.

It will be understood that the presence of the venturi by-pass 5*a* does not affect the action of the venturi 5 to control the opening and shutting of the main gas valve 20, the by-pass 5*a* and the adjustable flow control valve 5*b* in it merely allow variation of the total water flow through the water heater.

I claim:

1. A control unit for a gas-fired water heater comprising a water flow passageway having an inlet and an outlet, water flow responsive means connected to said inlet, a gas flow passageway having an inlet and an outlet, a first gas flow control valve in the gas passageway, a linkage interconnecting the first gas valve with the water flow responsive means, a further gas flow control valve in said gas passageway, water flow control means for controlling water flow through said water passageway, and a user operated control interconnected with said further gas flow control valve and with said water flow control means whereby operation by a user of said user operated control sets both the gas flow along said gas flow passageway and the water flow along said water flow passageway.

2. A control unit as claimed in claim 1 in which said water flow responsive means further comprises a water flow governor constituting said water flow control means, in which said first gas valve includes resilient means for loading said first gas valve against operation by said water flow responsive means, and in which said user operated control is linked to said first gas valve via said resilient means, operation of said user operated control varying said resilient loading and thereby the setting of the water flow governor and the flow of water along said water flow passageway.

3. A control unit as claimed in claim 2 and further comprising a first cam surface on said user operated control and a linkage interconnecting said first cam surface with said resilient means.

4. A control unit as claimed in claim 3 and further comprising a second cam surface on said user operated control and a further linkage interconnecting said second cam surface with said further gas flow control valve.

5. A control unit as claimed in claim 1 and further comprising first and second cam surfaces on said user operated control, a first linkage interconnecting said first cam surface with said further gas flow control valve, and a second linkage interconnecting said second cam surface with said water flow control means.

6. A control unit as claimed in claim 1 and further comprising, in said water flow responsive means, a venturi with a mouth and a throat, a device for responding to the difference in water pressure between said mouth and said throat, a further water flow passageway by-passing said venturi, and in which said water flow control means comprises a flow control valve in said further water flow passageway.

7. A control unit as claimed in claim 1 and further comprising, in said water flow responsive means, a venturi with a mouth and a throat, a device for responding to the difference in water pressure between said mouth and said throat, a further water flow passageway by-passing said venturi, said water flow control means comprising a water flow control valve in said further passageway, a flame failure unit comprising a pilot burner and said further gas flow control valve, and in which said user operated control is adapted to actuate said further gas flow control valve to permit gas flow only to said pilot burner for start-up purposes.

* * * * *